US007552739B2

(12) United States Patent
Chu et al.

(10) Patent No.: US 7,552,739 B2
(45) Date of Patent: Jun. 30, 2009

(54) COLLAPSIBLE STRUCTURE

(75) Inventors: Wan Sing Chu, Hong Kong (CN); Lai Ha Wu, Hong Kong (CN)

(73) Assignee: Best Tide Mfg. Co., Ltd., Sheung Wan, Hong Kong (CN)

( * ) Notice: Subject to any disclaimer, the term of this patent is extended or adjusted under 35 U.S.C. 154(b) by 107 days.

(21) Appl. No.: 11/529,568

(22) Filed: Sep. 28, 2006

(65) Prior Publication Data

US 2007/0079858 A1 Apr. 12, 2007

Related U.S. Application Data

(60) Provisional application No. 60/724,816, filed on Oct. 11, 2005.

(51) Int. Cl.
*E04H 15/40* (2006.01)
*E04H 15/48* (2006.01)

(52) U.S. Cl. ..... 135/126; 135/143; 135/151

(58) Field of Classification Search ..... 135/124–126, 135/128, 144, 114, 146–149, 151; 52/641
See application file for complete search history.

(56) References Cited

U.S. PATENT DOCUMENTS 5,370,145 A 12/1994 Wu
6,289,910 B1 * 9/2001 Zheng ..... 135/125
6,705,338 B2 * 3/2004 Zheng ..... 135/126
2002/0096205 A1 * 7/2002 Zheng ..... 135/126
2003/0196690 A1 * 10/2003 Chu et al. ..... 135/95

FOREIGN PATENT DOCUMENTS

| | | |
|---|---|---|
| CN | 2326680 | 6/1999 |
| CN | 2623795 | 7/2004 |
| CN | 1676983 | 10/2005 |
| GB | 2284621 | 6/1995 |

* cited by examiner

*Primary Examiner*—David Dunn
*Assistant Examiner*—Danielle Jackson
(74) *Attorney, Agent, or Firm*—Wilkinson & Grist; George G. Wang

(57) ABSTRACT

A collapsible structure having a first fabric-covered frame defining a first side panel, a second fabric-covered frame defining a second side panel, a fabric sheet mounted on and extending along the first and second fabric-covered frames; and a plurality of frame supports mounted on the fabric sheet whereby folding of the frame supports drives the first and second side panels towards a collapsed and superimposed position, and unfolding of the frame supports drives the first and second side panels towards a spaced apart and expanded position, and wherein the first and second side panels in the collapsed and superimposed position can be twisted and folded into a compact configuration.

13 Claims, 8 Drawing Sheets

COLLAPSIBLE STRUCTURE

CROSS-REFERENCE TO RELATED APPLICATIONS

This application claims the benefit of U.S. Provisional Patent Application No. 60/724,816 filed Oct. 11, 2005, which is hereby incorporated by reference in its entirety.

FIELD OF THE INVENTION

The present invention relates to a collapsible structure and, in particular, to a collapsible children playhouse.

BACKGROUND OF THE INVENTION

Collapsible structures are known in prior art. Such collapsible structures are commonly incorporated into items such as collapsible infant playpens, children playhouses, tents, pavilions, shelters, sun shields, etc.

U.S. Pat. No. 6,289,910 discloses a collapsible structure having a base panel that includes separate first and second sides, a foldable frame member having a folded and an unfolded orientation, and a fabric material covering portions of the frame member to form the base panel when the frame member is in the unfolded orientation. The structure also includes first and second loops, each loop having a foldable frame member having a folded and an unfolded orientation. The first side of the base panel is coupled to the first loop, and the second side of the base panel is coupled to the second loop.

U.S. Pat. No. 6,705,338 discloses a collapsible structure including a first vertical panel, a second vertical panel, and a member connecting the first and second vertical panels. The first vertical panel has a top edge and a foldable frame member having a folded and an unfolded orientation. A fabric material covers portions of the frame member to form the first panel when the frame member is in the unfolded orientation.

The second vertical panel has a top edge and a foldable frame member having a folded and an unfolded orientation. A fabric material covers portions of the frame member of the second panel to form the second panel when the frame member of the second panel is in the unfolded orientation.

The connecting member has opposing edges that are coupled to the top edges of the first and second panels in a manner such that the first and second panels are positioned spaced from each other. The connecting member includes means for supporting the first and second panels in an upright position that is parallel to each other. Each of the frame members of the first and second panels is twisted and folded to form a plurality of concentric rings when the frame member is in the folded orientation.

However, the frame members of these collapsible structures are rigidly connected to one another rendering these collapsible structures difficult to twist and fold into a compact configuration for easy storage.

SUMMARY OF THE INVENTION

According to one aspect of the present invention, there is provided a collapsible structure having a first fabric-covered frame defining a first side panel, a second fabric-covered frame defining a second side panel, a fabric sheet mounted on and extending along the first and second fabric-covered frames, and a plurality of frame supports mounted on the fabric sheet whereby folding of the frame supports drives the first and second side panels towards a collapsed and superimposed position, and unfolding of the frame supports drives the first and second side panels towards a spaced apart and expanded position, and wherein the first and second side panels in the collapsed and superimposed position can be twisted and folded into a compact configuration.

In an embodiment, each of the first and second fabric-covered frames is made of a flexible strip or rod being formed into a loop, and each of the first and second fabric-covered frames has an elongated ground-engaging section.

In an embodiment, at least one of the frame supports comprises a first section, and a second section pivotally connected to the first section by a pivoting mechanism. The first and second sections may take the form of a tube or rod.

In an embodiment, each frame support is received within a fabric sleeve that is fastened to the fabric sheet. The opposite free ends of each frame support are fastened within the opposite ends of each fabric sleeve respectively. The opposite ends of each fabric sleeve define two flexible links whereby each frame support is flexibly connected to the first and second fabric-covered frames.

In an embodiment, each fabric sleeve has an opening through which the pivoting mechanism of each frame support can be exposed whereby folding and unfolding of each frame support can be facilitated.

In an embodiment, at least one of the frame supports is in the form of a one-piece tube or rod. Each frame support is received within a fabric sleeve that is fastened to the fabric sheet.

In an embodiment, the first and second side panels are generally upright and parallel to each other in the expanded position.

In another embodiment, the first and second side panels are disposed at an angle to each other and tapering upwards in the expanded position.

In an embodiment, the collapsible structure further comprises a third frame located between the first and second fabric-covered frames and fastened to the fabric sheet.

In an embodiment, the first, second and third frames, and the frame supports are made of plastic or metal.

In an embodiment, the fabric sheet and the first and second side panels together define an enclosure when the first and second side panels are in the spaced apart and expanded position. At least one of the fabric sheet and the first and second side panels has an opening through which a player can enter or exit the enclosure.

In an embodiment, the collapsible structure is a children playhouse.

According to another aspect of the present invention, there is provided a collapsible structure including (a) a first looped frame defining a first side panel; (b) a second looped frame defining a second side panel; and (c) a plurality of frame supports pivotally or flexibly connecting the first looped frame and the second looped frame and, each the frame support having at least two sections pivotally connected together by a connector and being capable of changing between a closed configuration and an open configuration by folding and unfolding around the connector, wherein when the frame supports are in the open configuration at least one additional side panel is formed, which together with the first side panel and the second panel defines an inner space encompassed by the first panel, the second panel and the additional side panel; the additional side panel being defined by one or more of the frame supports, a portion of the first looped frame and a portion of the second looped frame.

Although the invention is shown and described with respect to certain embodiments, it is obvious that equivalents and modifications will occur to others skilled in the art upon the reading and understanding of the specification. The present invention includes all such equivalents and modifications, and is limited only by the scope of the claims.

BRIEF DESCRIPTION OF THE DRAWINGS

Specific embodiments of the invention will now be described by way of example with reference to the accompanying drawings wherein.

DETAILED DESCRIPTION OF PREFERRED EMBODIMENTS

Figure 1:
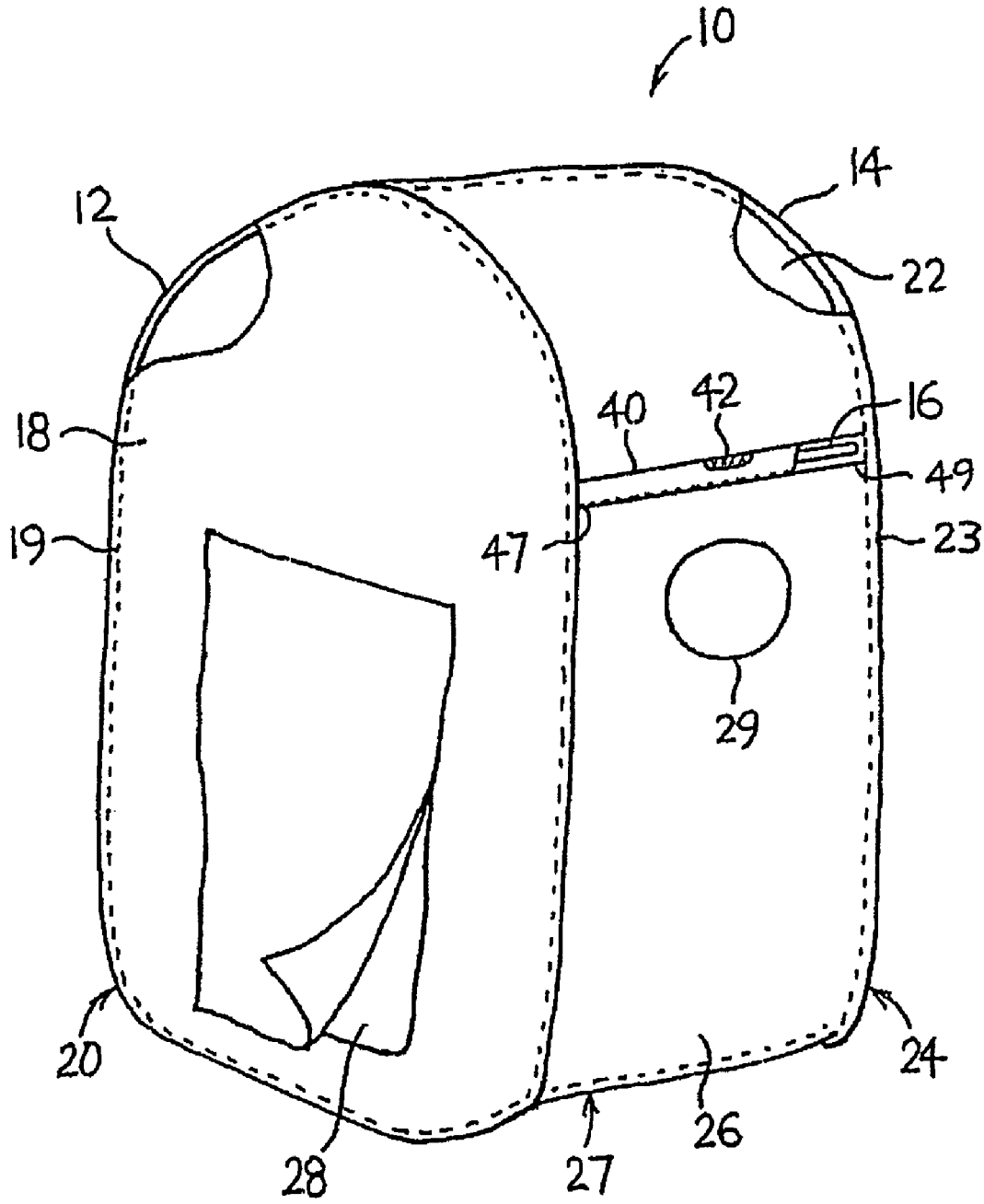
FIG. 1 is a perspective view of a collapsible structure in accordance with a first embodiment of the present invention.

Reference will now be made in detail to a preferred embodiment of the invention, examples of which are also provided in the following description. Exemplary embodiments of the invention are described in detail, although it will be apparent to those skilled in the relevant art that some features that are not particularly important to an understanding of the invention may not be shown for the sake of clarity.

Furthermore, it should be understood that the invention is not limited to the precise embodiments described below and that various changes and modifications thereof may be effected by one skilled in the art without departing from the spirit or scope of the invention. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the spirit and scope of the present invention.

For illustration purposes, the terms "upper", "lower", "top", "bottom", "upwards", "downwards", or similar terms appeared hereinafter relate to the invention as it is oriented in the drawings. It is understood that the invention may assume various positions, except where expressly specified to the contrary. Furthermore, it is understood that the specific devices shown in the drawings, and described in the following description, are simply exemplary embodiments of the invention. Hence, specific dimensions and other physical characteristics related to the embodiments disclosed hereinafter are not to be considered as limiting.

Also, the terms "connected" and "coupled", when used in this disclosure to describe the relationship between two or more structures, mean that such structures are secured or attached to each other either directly or indirectly through intervening structures, and includes pivotal connections.

Figure 2:
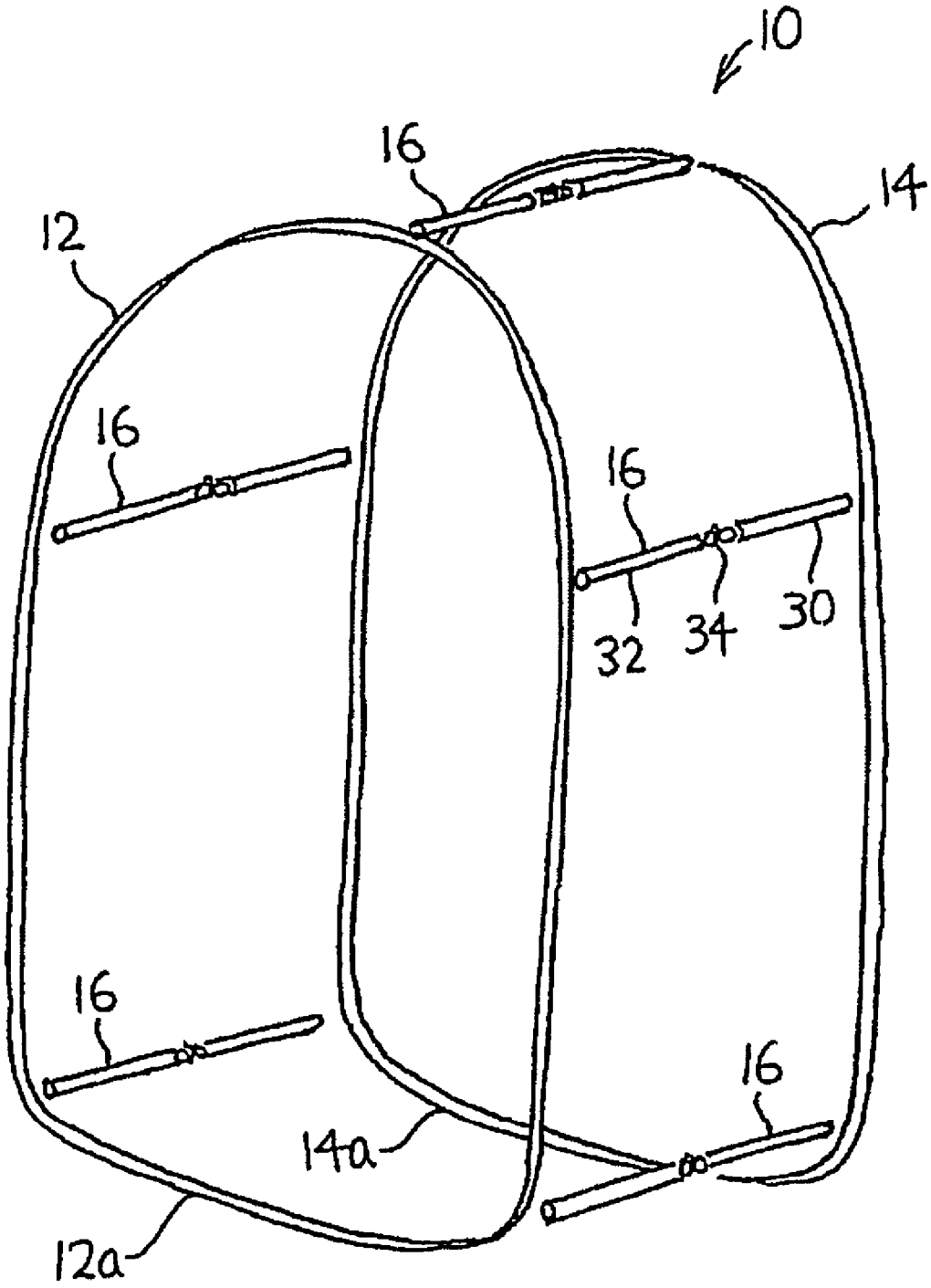
FIG. 2 is a perspective view of the frames of the collapsible structure of FIG. 1.

Referring now to the drawings, in which like reference numerals represent like parts throughout the drawings, FIG. 1 shows a collapsible structure 10 in the form of a children playhouse. The collapsible structure 10 is in an erected and expanded position. FIG. 2 shows the frames of the collapsible structure 10 of FIG. 1.

According to the present embodiment, the collapsible structure 10 includes a pair of frames 12, 14, and a plurality of frame supports generally denoted by reference numeral 16. Each of the frames 12, 14 can be made of a flexible plastic or metal strip formed into a loop. Each of the looped or loop-shaped frames 12, 14 has a generally elongated section defining a ground-engaging section 12*a*, 14*a*. The two loop-shaped frames 12, 14 are adapted to be erected in a generally upright position with the ground-engaging sections 12*a*, 14*a* in engagement with the ground. The frame supports 16 are adapted to support and maintain the two frames 12, 14 in the erected and expanded position.

A sheet of fabric material 18 is adapted to cover the frame 12 so as to form a side panel 20 of the structure 10. Another sheet of fabric material 22 is adapted to cover the frame 14 so as to form an opposite side panel 24 of the structure 10. The loop-shaped frames 12, 14 are received within sleeves 19, 23 formed around the edges of the fabric sheets 18, 22 respectively. Due to the resilience of the loop-shaped frames 12, 14, the sleeves 19, 23 are normally distended by the loop-shaped frames 12, 14 and the fabric sheets 18, 22 are normally extended and stretched out.

The collapsible structure 10 has another sheet of fabric material 26 that extends between and along the two loop-shaped frames 12, 14. This sheet of fabric material 26 is adapted to be foldable. When the collapsible structure 10 is in its expanded configuration, this fabric sheet 26 is stretched out, as illustrated in FIG. 1. This stretched out fabric sheet 26 together with the fabric sheets 18, 22 define an inner space or enclosure of the playhouse structure 10.

Preferably, the fabric sheets 18, 22, 26 are made of nylon, polyester, or other materials that are durable and easy to clean. The fabric sheets 18, 22, 26 are fastened to the frames 12, 14 by conventional means such as stitching.

An opening 28 is provided on the playhouse structure 10, for example, on the side panel 20 thereof allowing players to enter or exit the structure 10 when it is in its erected and fully expanded position. One or more windows 29 may also be provided on the playhouse structure 10.

There is a plurality of frame supports 16 employed to support and maintain the frames 12, 14 in the erected and fully expanded position. In the illustrated embodiment, there are five frame supports 16. One of the frame supports 16 is disposed at the top of the collapsible structure 10. Two of the frame supports 16 are disposed at a middle portion of the collapsible structure 10. The remaining two frame supports 16 are disposed at a lower portion of the collapsible structure 10 proximate to the ground-engaging sections 12*a*, 14*a* of the frames 12, 14.

Each frame support 16 includes a first section 30, and a second section 32 pivotally connected to the first section 30 by a connector or pivoting mechanism, generally designated by reference numeral 34. Preferably, each of the first and second sections 30, 32 is made of a plastic or metal tube.

Figure 2A:
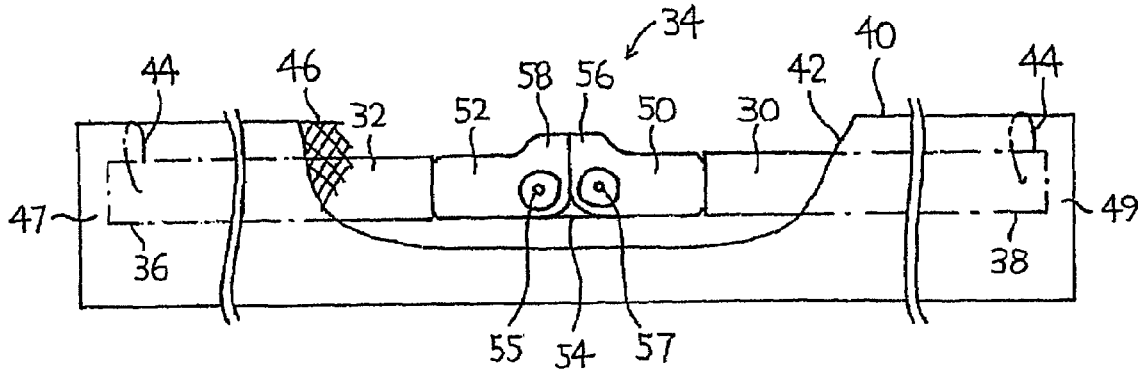
FIG. 2A is a fragmentary view of a frame support in an unfolded position.
Figure 2B:
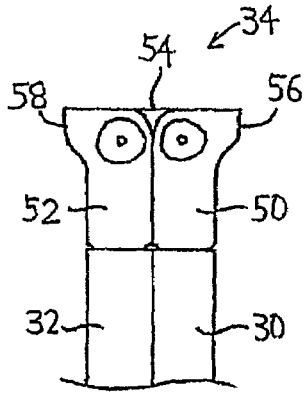
FIG. 2B shows a fragmentary view of the frame support of FIG. 2A in a folded position.
Figure 3:
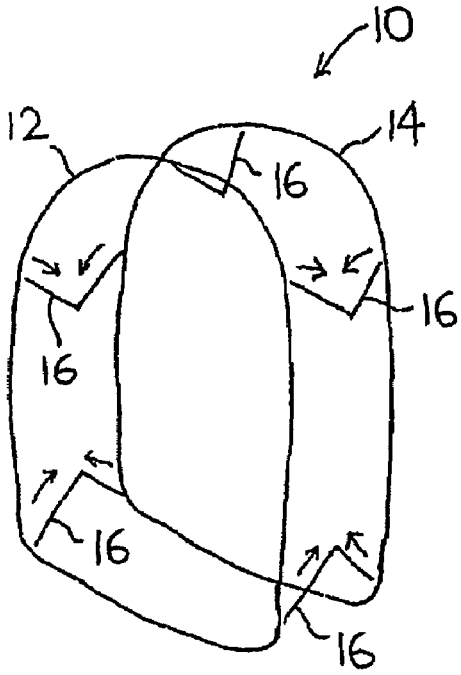
FIG. 3 is a perspective view of the frames of the collapsible structure of FIG. 1 in a partially collapsed position.

The frame support 16 is adapted to be unfolded into an open configuration or extended position where the first and second sections 30, 32 are in a generally collinear relationship, as depicted in FIG. 2A. The frame support 16 is also adapted to be folded into a closed configuration or folded position where the first and second sections 30, 32 abut against each other, as depicted in FIG. 2B.

The pivoting mechanism 34 includes a first segment 50 and a second segment 52. The first and second segments 50, 52 are pivotally connected by a bridge member 54 and pivotally moveable about respective pivot pins 55, 57. One end of the first segment 50 is fixedly coupled to one end of the first tubular section 30. Similarly, one end of the second segment 52 is fixedly coupled to one end of the second tubular section 32.

Projections 56, 58 are provided on the first and second segments 50, 52 respectively. The projections 56, 58 serve to limit and maintain the first and second sections 30, 32 in a generally collinear relationship when the frame support 16 is fully unfolded.

Although the use of one kind of pivoting mechanism 34 has been described, it is appreciated that other kinds of pivoting or hinge mechanisms may be employed.

Instead of being directly connected to the frames 12, 14 as in the prior art, the frame supports 16 of the present invention are connected to the fabric sheet 26 that extends between the frames 12, 14. When the frame supports 16 are in their unfolded and extended positions, the fabric sheet 26 is substantially stretched out and the side panels 20, 24 are disposed vertically in a generally parallel and spaced apart relationship. The fabric sheet 26, one or more of the frame supports 16, and a portion of each frame 12, 14 together define an additional side panel 27 of the collapsible structure 10.

Preferably, each frame support 16 can be received within a fabric sleeve 40 that is fastened to the fabric sheet 26 by stitching. The opposite free ends 36, 38 of the frame support 16 are fastened within the opposite ends 47, 49 of the fabric sleeve 40 respectively by fastening means such as plastic cable ties 44. When the frame support 16 is in its fully unfolded position, the free ends 36, 38 generally abut against the frames 12, 14 respectively. The opposite ends 47, 49 of the fabric sleeve 40 define two flexible links whereby the frames 12, 14 and the frame supports 16 can be flexibly and movably connected, and foldable against one another such that the collapsible structure 10 can be easily collapsed, twisted and folded into a compact configuration for storage.

The fabric sleeve 40 can have an opening 42 through which the pivoting mechanism 34 of the frame support 16 can be exposed and visible so that folding and unfolding of the frame supports 16 can be facilitated. A net 46 may be employed to cover the entire opening 42.

Figure 4:
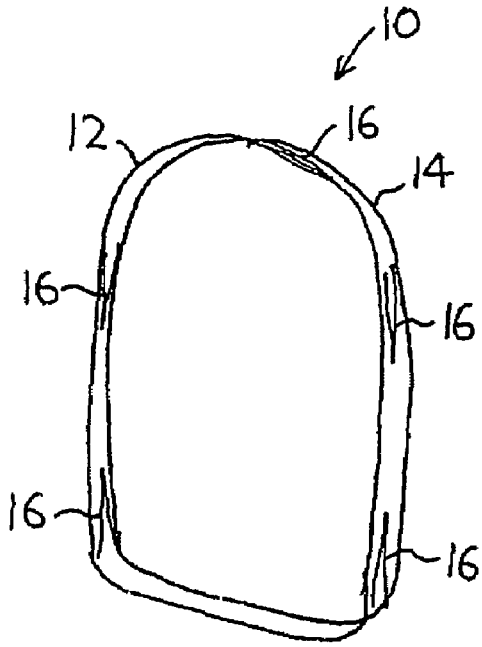
FIG. 4 is a perspective view of the frames of the collapsible structure of FIG. 1 in a collapsed and superimposed position.

FIGS. 3-6 show the steps of collapsing and folding the structure 10. The frame supports 16 are first folded one by one, as illustrated by the arrows in FIG. 3. When all the frame supports 16 are folded, the frames 12, 14 are driven into a generally superimposed position, as depicted in FIG. 4.

Figure 5:
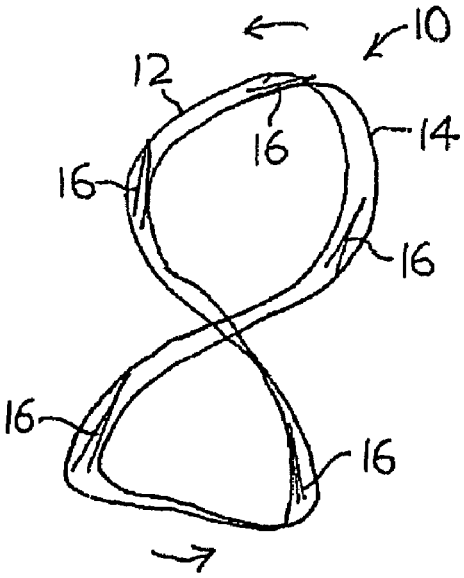
FIG. 5 is a perspective view of the collapsed and superimposed frame structure of FIG. 4 in a twisted and partially folded position.
Figure 6:
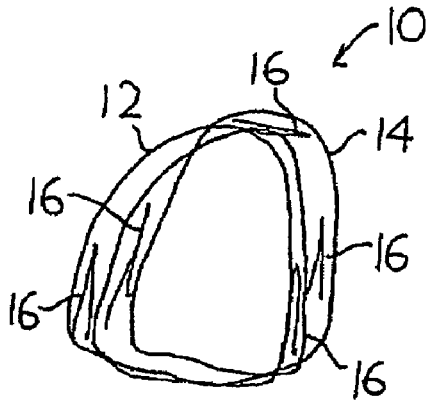
FIG. 6 is a perspective view of the frames of the collapsible structure of FIG. 1 in a fully collapsed and folded position.
Figure 8:
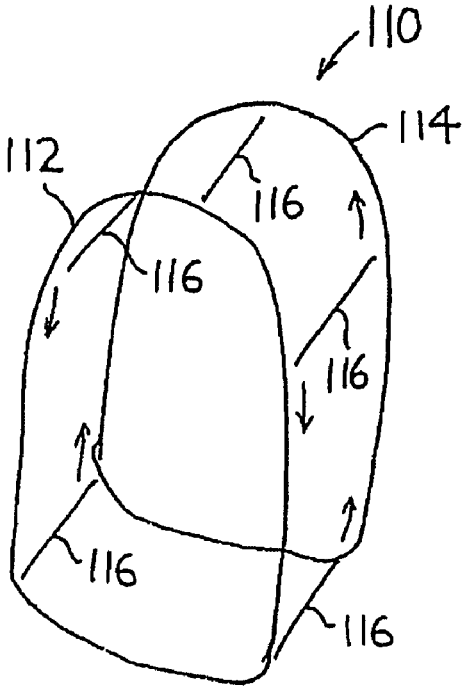
FIG. 8 is a perspective view of the collapsible structure of FIG. 7 in a partially collapsed position.

With the provision of the flexible links 47, 49 between the frames 12, 14 and the frame supports 16, the collapsed and superimposed frames 12, 14 can be twisted into a figure-8 structure, as indicated by the arrows in FIG. 5. The two halves of the figure-8 structure can then be folded against each other into a fully collapsed and folded structure 10 in a compact configuration, as shown in FIG. 6. The fully collapsed and folded structure 10 may be stored in a pouch.

The collapsible structure 10 can be unfolded by reversing the above-mentioned collapsing and folding steps.

When the fully collapsed and folded structure 10 is released, the frames 12, 14 spring back or pop up into its normal unfolded and extended loop-shaped configuration under the influence of the resilience of the frames 12, 14. The structure 10 can further be expanded to its fully unfolded position by unfolding the frame supports 16 one after the other.

Figure 7:
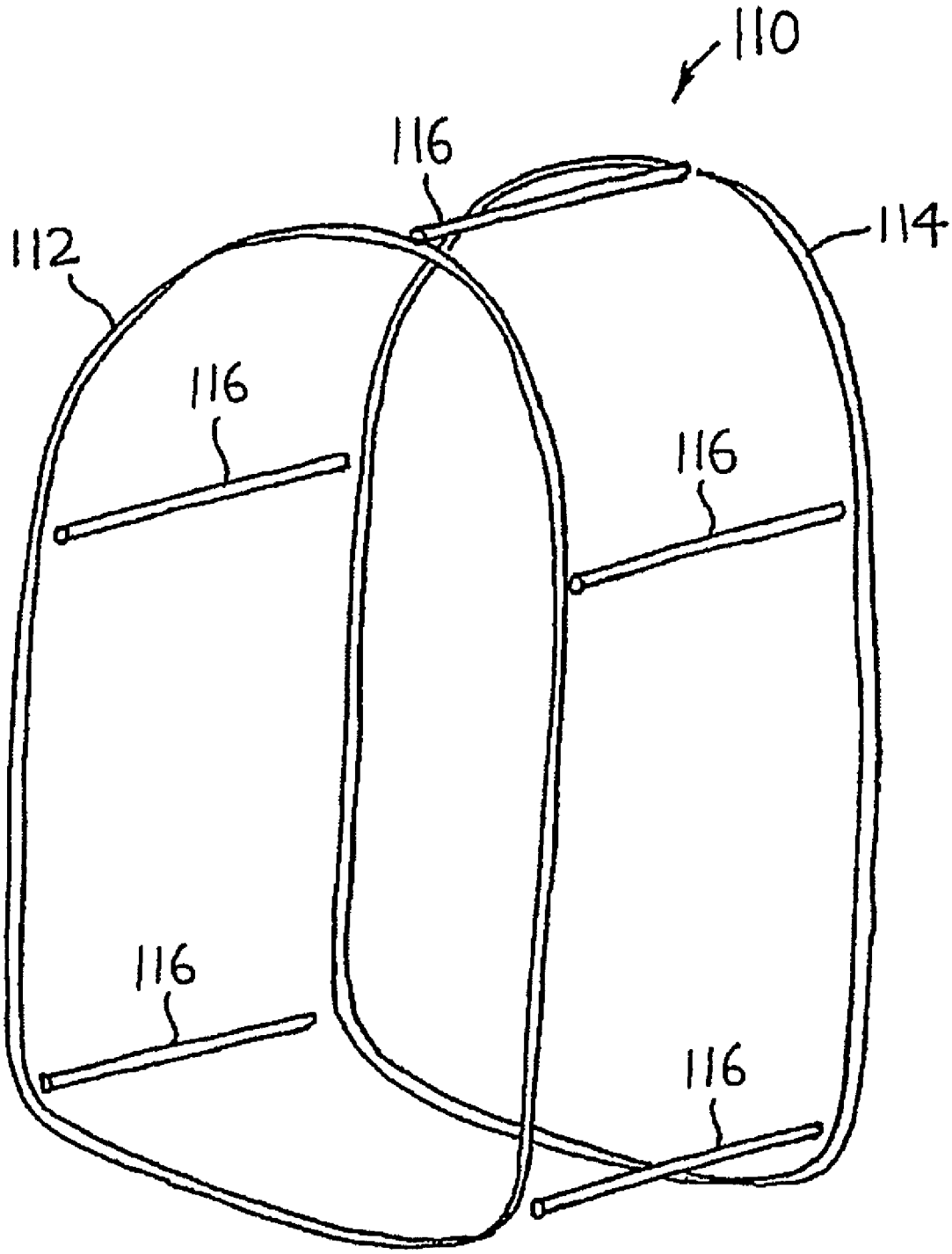
FIG. 7 is a perspective view of a collapsible structure in accordance with a second embodiment of the present invention.

FIG. 7 is a perspective view of a collapsible frame structure 110 in accordance with a second embodiment. The collapsible frame structure 110 is similar to the collapsible frame structure 10 shown in FIG. 2 except that the foldable frame supports 16 are substituted by non-foldable frame supports 116. Each of these non-foldable frame supports 116 preferably takes the form of a one-piece elongated rigid tube or rod made of plastic or metal. Similar to the frame supports 16, these non-foldable frame supports 116 are mounted on fabric sheets of the frame structure 110. The non-foldable frame supports 116 serve to support and maintain the frames 112, 114 in a spaced apart and expanded position.

Figure 9:
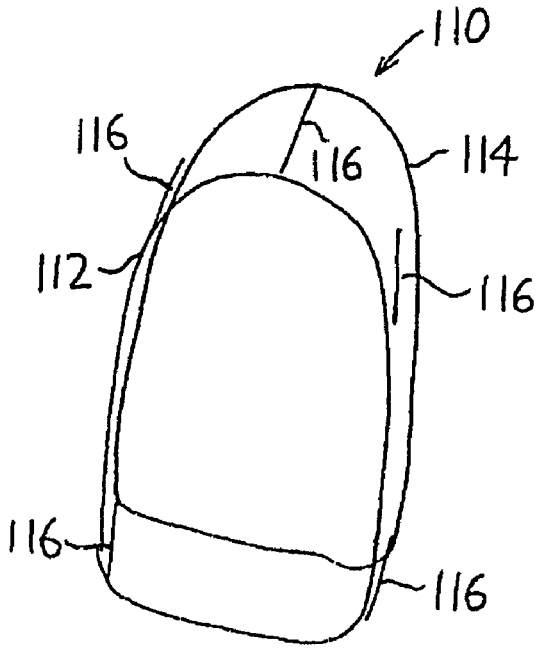
FIG. 9 is a perspective view of the collapsible structure of FIG. 7 in a collapsed and superimposed position.

FIGS. 8-11 show the steps of collapsing and folding the structure 110. The frames 112, 114 and a plurality of frame supports 116 are first collapsed, as indicated by the arrows in FIG. 8. When the frames 112, 114 and the frame supports 116 are fully collapsed, the frames 112, 114 and the frame supports 116 are disposed in a generally superimposed position, as depicted in FIG. 9.

Figure 10:
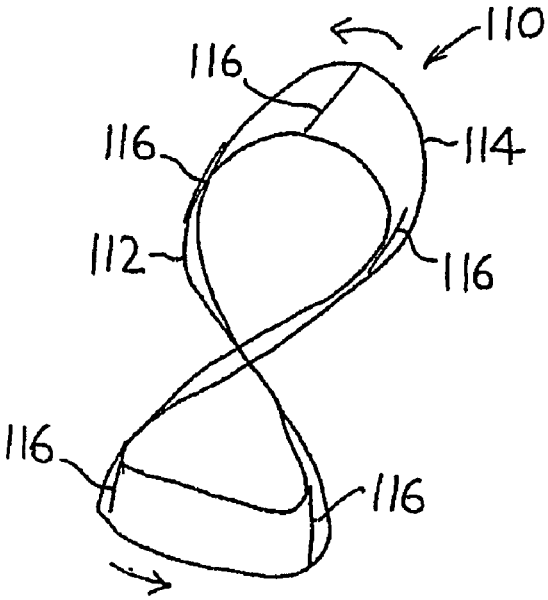
FIG. 10 is a perspective view of the collapsed and superimposed structure of FIG. 9 in a twisted and partially folded position.
Figure 11:
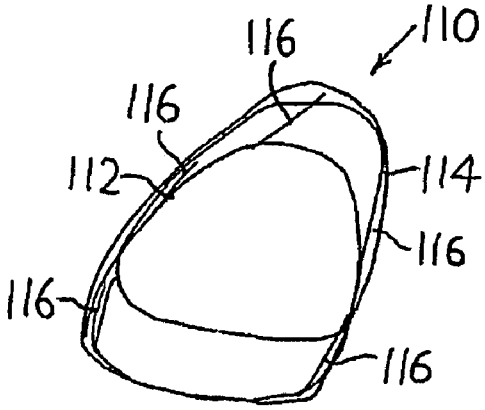
FIG. 11 is a perspective view of the collapsible structure of FIG. 7 in a fully collapsed and folded position.

The collapsed and superimposed frames 112, 114 are then twisted into a figure-8 structure, as shown by the arrows in FIG. 10. The two halves of the figure-8 structure are then folded against each other into a fully collapsed and folded structure 110, as shown in FIG. 11.

The collapsible structure 110 can be unfolded by reversing the above-mentioned collapsing and folding steps.

Although it has been shown that the frames 12, 14, 112, 114 are in parallel relationship when the collapsible structure 10, 110 is unfolded, it is appreciated that the frames 12, 14, 112, 114 may be disposed at an angle to each other.

Figure 12:
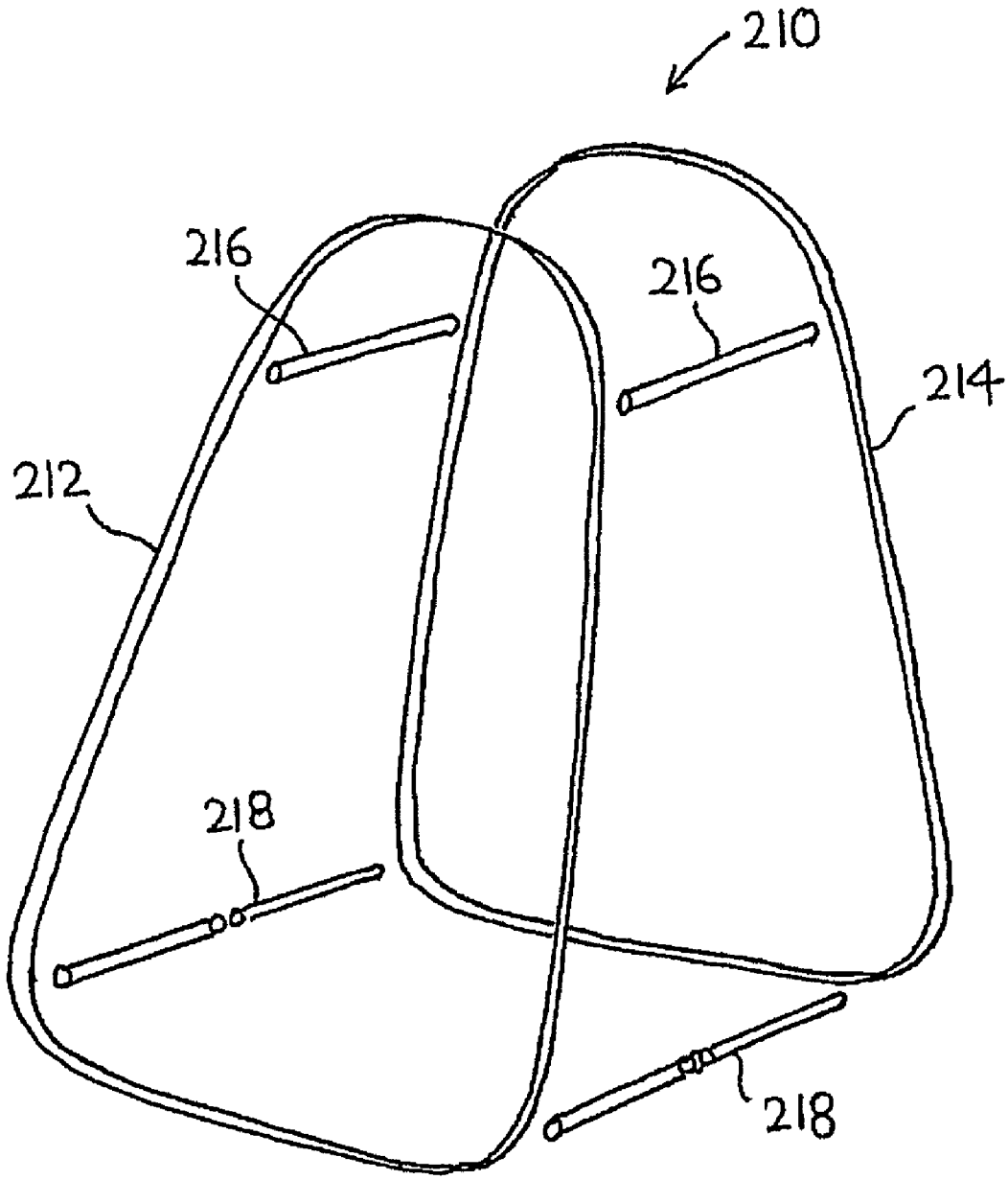
FIG. 12 is a perspective view of a collapsible structure in accordance with a third embodiment of the present invention.

FIG. 12 is a perspective view of a collapsible structure 210 in accordance with a third embodiment having two frames disposed at an angle to each other. The collapsible structure 210 has two slanted frames 212, 214, two upper frame supports 216 and two lower frame supports 218.

When unfolded and erected, the two frames 212, 214 taper upwards so that the distance between the upper edges of the frames 212, 214 is shorter than the distance between the lower edges of the frames 212, 214. Accordingly, the length of the upper frame supports 216 is shorter than the length of the lower frame supports 218.

According to the present embodiment, the upper frame supports 216 may be in the form of one-piece non-foldable tubes or rods, and the lower frame supports 218 may be foldable frame supports as illustrated in FIGS. 2A and 2B.

It has been described hereinbefore that the collapsible structure 10, 110, 210 has two loop-shaped frames 12, 14, 112, 114, 212, 214. However, it is understood that the number, shape, and size of the frames 12, 14, 112, 114, 212, 214 may vary. For example, the collapsible structure 10, 110, 210 may have one or more additional frames coupled to the two frames 12, 14, 112, 114, 212, 214. The frames 12, 14, 112, 114, 212, 214 may be of any shapes including but not limit to rectangular, circular, oval, oblong, hexagonal and polygonal shapes. Furthermore, it is understood that the collapsible structure 10, 110, 210 may have different number of frame supports 16, 116, 216, 218.

Figure 13:
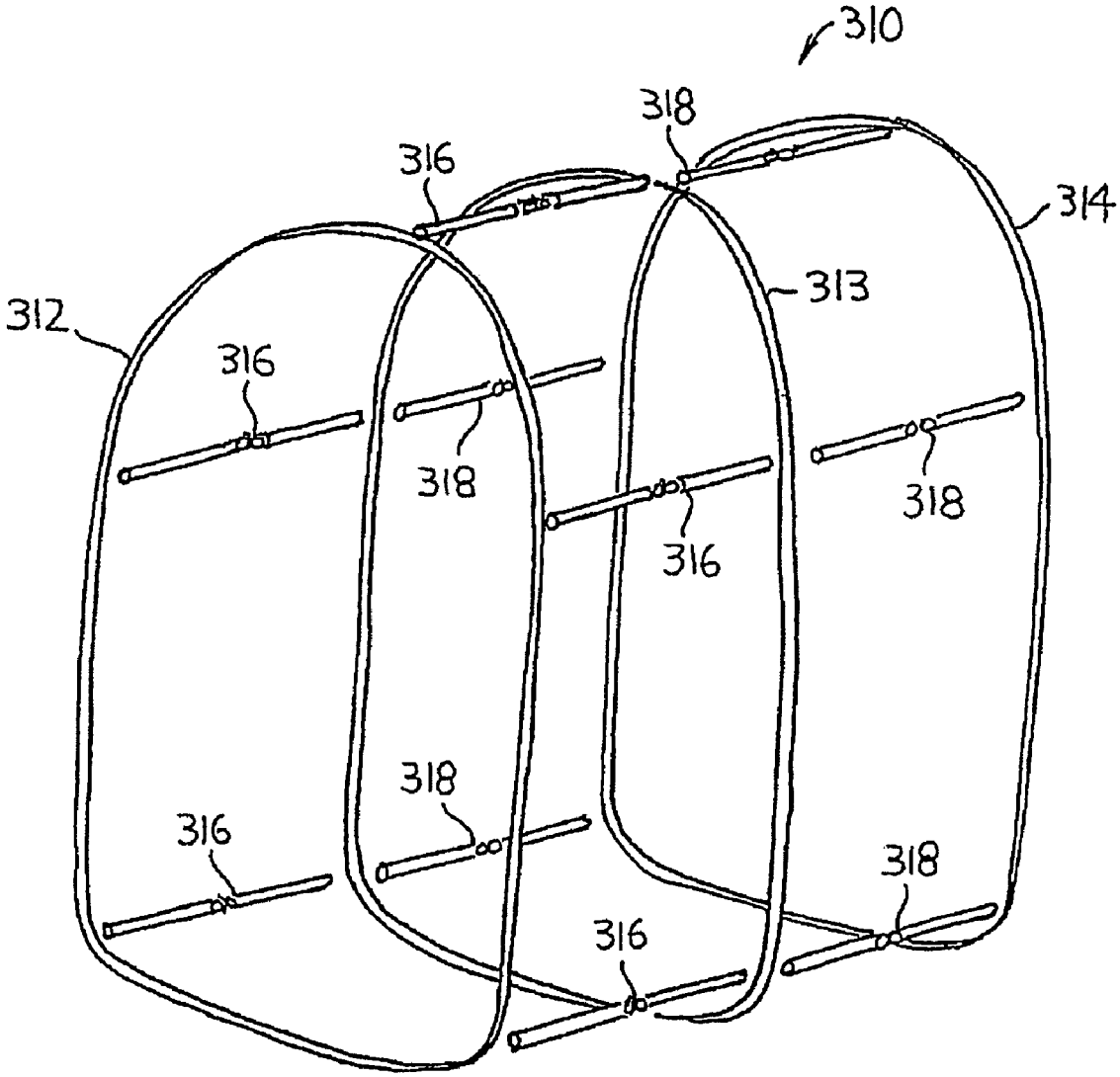
FIG. 13 is a perspective view of a collapsible structure in accordance with a fourth embodiment of the present invention.

FIG. 13 is a perspective view of a collapsible structure 310 in accordance with a fourth embodiment. The collapsible structure 310 has three frames 312, 313, 314. A plurality of frame supports 316 is adapted to support the frames 312, 313. A plurality of frame supports 317 is adapted to support the frames 313, 314.

Although it has been described hereinbefore that the frames 12, 14, 112, 114, 212, 214, 312, 313, 314 are made of flexible plastic or metal strips, it is understood that the frames 12, 14, 112, 114, 212, 214, 312, 313, 314 may be made of other suitable materials including but not limit to flexible wires, rods and tubes made of plastic or metal.

Furthermore, although it has been described that the frame supports 16, 116, 216, 218, 316, 318 are made of plastic or metal tubes, it is appreciated that the frame supports 16, 116, 216, 218, 316, 318 may be made of other suitable materials including but not limit to plastic or metal rods, wires, strips and bars.

While the present invention has been shown and described with particular references to a number of preferred embodiments thereof, it should be noted that various other changes or modifications may be made without departing from the scope of the present invention.

What is claimed is:

1. A collapsible structure comprising:

(a) a first fabric-covered frame defining a first side panel;

(b) a second fabric-covered frame defining a second side panel;

(c) a fabric sheet mounted on and extending along said first and second fabric-covered frames; and (d) a plurality of frame supports mounted on said fabric sheet whereby folding of said frame supports drives said first and second side panels towards a collapsed and superimposed position, and unfolding of said frame supports drives said first and second side panels towards a spaced apart and expanded position, and wherein said first and second side panels in said collapsed and superimposed position are foldable into a compact configuration;

wherein at least one of said frame supports comprises a first section, and a second section pivotally connected to said first section by a pivoting mechanism, said first and second sections being in the form of a tube or rod; and wherein each of said first and second fabric-covered frames is made of a flexible strip or rod being formed into a loop, the first and second fabric-covered frames being twistable into a figure-8 shape.

2. The structure according to claim 1 wherein each of said first and second fabric-covered frames has an elongated ground-engaging section.

3. The structure according to claim 1 wherein each frame support is received within a fabric sleeve that is fastened to said fabric sheet.

4. The structure according to claim 3 wherein the opposite free ends of each frame support are fastened within the opposite ends of each fabric sleeve respectively, and said opposite ends of each fabric sleeve define two flexible links whereby each frame support is flexibly connected to said first and second fabric-covered frames.

5. The structure according to claim 4 wherein each fabric sleeve has an opening through which said pivoting mechanism of each frame support can be exposed whereby folding and unfolding of each frame support can be facilitated.

6. The structure according to claim 1 wherein each frame support is received within a fabric sleeve that is fastened to said fabric sheet.

7. The structure according to claim 1 wherein said first and second side panels are generally upright and parallel to each other in said expanded position.

8. The structure according to claim 1 wherein said first and second side panels are disposed at an angle to each other and tapering upwards in said expanded position.

9. The structure according to claim 1 further comprising a third frame located between said first and second fabric-covered frames and fastened to said fabric sheet.

10. The structure according to claim 9 wherein said first, second and third frames, and said frame supports are made of plastic or metal.

11. The structure according to claim 1 wherein said fabric sheet and said first and second side panels together define an enclosure when said first and second side panels are in said spaced apart and expanded position.

12. The structure according to claim 11 wherein at least one of said fabric sheet and said first and second side panels has an opening through which a player can enter or exit said enclosure.

13. The structure according to claim 1 wherein said structure is a children playhouse.

* * * * *